US010532239B1

(12) United States Patent
Suarez Monne

(10) Patent No.: US 10,532,239 B1
(45) Date of Patent: Jan. 14, 2020

(54) APPARATUS FOR EXERCISING

(71) Applicant: Denis Suarez Monne, Guayaquil (EC)

(72) Inventor: Denis Suarez Monne, Guayaquil (EC)

( * ) Notice: Subject to any disclaimer, the term of this patent is extended or adjusted under 35 U.S.C. 154(b) by 115 days.

(21) Appl. No.: 15/874,168

(22) Filed: Jan. 18, 2018

(51) Int. Cl.

| | |
|---|---|
| ***A63B 21/04*** | (2006.01) |
| ***A63B 23/02*** | (2006.01) |
| ***A63B 21/00*** | (2006.01) |
| ***A63B 21/055*** | (2006.01) |
| ***A63B 21/062*** | (2006.01) |
| ***A63B 23/12*** | (2006.01) |
| ***A63B 21/02*** | (2006.01) |

(52) U.S. Cl.
CPC ..... *A63B 21/04* (2013.01); *A63B 21/00043* (2013.01); *A63B 21/0557* (2013.01); *A63B 21/063* (2015.10); *A63B 23/0211* (2013.01); *A63B 23/12* (2013.01); *A63B 21/00069* (2013.01); *A63B 21/025* (2013.01); *A63B 23/0233* (2013.01); *A63B 2208/0204* (2013.01); *A63B 2208/0233* (2013.01); *A63B 2225/093* (2013.01)

(58) Field of Classification Search
CPC ... A63B 21/04; A63B 21/063; A63B 21/0557; A63B 21/00043; A63B 21/025; A63B 21/00069; A63B 23/12; A63B 23/0211; A63B 23/0233; A63B 2208/0204; A63B 2208/0233; A63B 2225/093; A63B 17/00; A63B 17/02; A63B 17/04; A63B 9/00; A63B 2009/00; A63B 2009/004; A63B 2009/006; A63B 71/023; F16B 7/105
USPC ..... 482/29, 36, 39, 120, 121, 123, 126, 129, 482/130, 133, 138
See application file for complete search history.

(56) References Cited

U.S. PATENT DOCUMENTS

| | | | | | |
|---|---|---|---|---|---|
| 1,374,697 | A | * | 4/1921 | Werndli | A63B 21/154 482/95 |
| D160,320 | S | * | 10/1950 | Horowitz | 482/36 |
| 2,704,667 | A | * | 3/1955 | Sanders | A63B 9/00 446/124 |
| 3,708,167 | A | | 1/1973 | Potgieter | |
| 4,018,437 | A | | 4/1977 | LoPresti | |
| 4,391,440 | A | | 7/1983 | Berger | |
| 5,050,869 | A | | 9/1991 | Frate | |
| 5,468,205 | A | | 11/1995 | McFall et al. | |

(Continued)

FOREIGN PATENT DOCUMENTS

| | | | | | |
|---|---|---|---|---|---|
| DE | 102012206701 | A1 | * | 10/2013 | A63B 17/02 |
| EP | 0215172 | A1 | | 3/1987 | |

*Primary Examiner* — Loan B Jimenez
*Assistant Examiner* — Zachary T Moore
(74) *Attorney, Agent, or Firm* — Albert Bordas, P.A.

(57) ABSTRACT

An apparatus for exercising having a frame assembly defining a triangular prism shape, which has a frame top bar that has connected a first set of frame lateral bars and a second set of frame lateral bars. The frame assembly further has first and second frame base bars and first and second frame lateral base bars. First and second clamp assemblies are mounted onto the frame top bar. The apparatus for exercising further has first and second band assemblies, a strap assembly, first and second upper handle assemblies, and a board assembly, which are removable from the frame assembly. The frame assembly is used for exercising alone and/or in conjunction with the first and second band assemblies, the strap assembly, the first and second upper handle assemblies, and the board assembly.

13 Claims, 4 Drawing Sheets

(56) References Cited

U.S. PATENT DOCUMENTS

| | | | | |
|---|---|---|---|---|
| 5,601,518 | A | 2/1997 | Weintraub | |
| 5,603,681 | A | 2/1997 | Olschansky et al. | |
| 6,110,081 | A | 8/2000 | Barrett | |
| 6,267,711 | B1 | 7/2001 | Hinds | |
| 6,394,932 | B1 * | 5/2002 | Chu | A63B 1/00 482/34 |
| 6,994,655 | B2 * | 2/2006 | Chu | A63B 1/00 472/118 |
| 7,410,450 | B1 | 8/2008 | Paulding | |
| 7,488,277 | B1 | 2/2009 | Knapp | |
| 7,591,763 | B1 | 9/2009 | Fucci | |
| 7,621,847 | B2 | 11/2009 | Lamle et al. | |
| 8,257,088 | B1 * | 9/2012 | Askins | G09B 19/003 434/247 |
| 9,005,090 | B2 * | 4/2015 | Latronica | A63B 23/0238 482/139 |
| 9,327,153 | B2 | 5/2016 | Wallisch | |
| 2002/0091043 | A1 | 7/2002 | Rexach | |
| 2005/0130814 | A1 | 6/2005 | Nitta et al. | |
| 2006/0194679 | A1 | 8/2006 | Hatchet | |
| 2010/0087295 | A1 * | 4/2010 | Crawley, IV | A63B 17/00 482/52 |
| 2010/0227743 | A1 * | 9/2010 | Jutte | A63B 21/16 482/87 |

* cited by examiner

APPARATUS FOR EXERCISING

BACKGROUND OF THE INVENTION

1. Field of the Invention

The present invention relates to training devices, and more particularly, to devices useful for exercising.

2. Description of the Related Art

Applicant believes that one of the closest references corresponds to U.S. Pat. No. 3,708,167 issued to Jacobus Daniel Potgieter on Jan. 2, 1973 for Exercising apparatus. However, it differs from the present invention because Potgieter teaches a body exercising apparatus for execution of a very large number of different exercises. The apparatus comprises a single upright post with a platform extending from one side of the bottom end and having pulley means on the top engaged by a cable of variable effective length. The cable is connected with one end in movement adjustable fashion to a weight-carrying lever attached to the post on a side opposite to the platform side whereas the opposite end of the cable is connectable to any one of a plurality of separate devices for engagement by a person on the platform for exercising purposes. Additional pulleys for optional engagement by the cable, rigid bar members and means for locking of the lever are also associated with the post.

Applicant believes that another reference corresponds to U.S. Pat. No. 4,018,437 issued to Roy F. LoPresti on Apr. 19, 1977 for Multipositionable portable and collapsible rectangular frame exercising apparatus with detachable support means. However, it differs from the present invention because LoPresti teaches an exercising apparatus having a frame made of detachably, telescopically coupled tubular members. Connected to the top most cross member of the frame is a substantially rigid spring member that extends between and removably connects the frame with a door. The substantially rigid spring member includes two parallel spaced arms. At the opposite end of the member are two longitudinally spaced elements that engage respectively the front surface of a door, the top of the door and the upper back surface of a door. With the substantially rigid spring member in place for use by an exerciser the frame will be spaced from the top of the door.

Applicant believes that another reference corresponds to U.S. Pat. No. 4,391,440 issued to Isaac Berger on Jul. 5, 1983 for Portable exercising apparatus. However, it differs from the present invention because Berger teaches a portable lightweight body-anchored exercising apparatus for use in exercising the human body made up of a frame, a pair of ropes with free ends pullable by a user, weights for resisting the pulling forces, and a base connected to the frame and on which the user rests his body during performance of exercises to hold the apparatus in place so that it does not move in response to the generally upward forces created by the pulling of ropes by the user. Additionally, the exercising apparatus includes a pulley system to permit the user to move his exercising limbs a distance greater than the excursion of the weights, handles for the user to grasp while pulling the ropes, sheaves for controlling the movement of the ropes, and guide pins for guiding the weights so that they cannot swing outwardly and harm the user. The weights are attached to the ropes with hooks to allow them to move jointly with the ropes.

Applicant believes that another reference corresponds to U.S. Pat. No. 5,050,869 issued to Richard A. Frate on Sep. 24, 1991 for Portable exercise machine. However, it differs from the present invention because Frate teaches an exercise unit or weight machine which may be mounted to a door frame for use. The device is designed for portability in that the unit may be quickly mounted to the door frame and dismounted therefrom, and is symmetric so as to allow the device to be used on either side of the door frame.

Applicant believes that another reference corresponds to U.S. Pat. No. 5,468,205 issued to McFall, et al. on Nov. 21, 1995 for Portable door mounted exercise apparatus. However, it differs from the present invention because McFall, et al. teach an exercise apparatus having a pair of pulley support units mounted on a door by straps, which vertically encircle the door. The support units are interconnected by a series of elastic bands, such as bungee cords that run vertical paths between the support units. The ends of the bands or cords are wrapped around pulleys and terminated such that a handle may be attached to each of the cords at either the top unit or the bottom unit. Various exercises are possible with one or two arms or legs by pulling on the cords with the handle. The apparatus is mounted or dismounted from any door or other vertically oriented and fixed-inplace partition, and is fold and store in a small carrying case.

Applicant believes that another reference corresponds to U.S. Pat. No. 5,601,518 issued to Mitchell Weintraub on Feb. 11, 1997 for Portable exercise device. However, it differs from the present invention because Weintraub teaches a portable exercise device that is usable in the home by attachment to supporting structure. The device comprises a pair of bases that are configured for attachment to a support, a member having a peripheral edge being pivotally attached to one of the bases and a bar being pivotally attached to the other base. One end of the bar is attached to the base to which the member is attached by a resistance mechanism. To the other end of the bar is attached a strap that engages a portion of the peripheral edge of the member and extends therefrom for attachment to a grip. This structure reduces the resistance force produced by the resistance mechanism as the exerciser approaches full contraction of the muscle group being exercised to ensure a completely full contraction is made. The device also compensates for the use of a non-linear resistance mechanism. In addition, the resistance provided by the device is adjustable, providing the appropriate resistance for the particular muscle group being exercised.

Applicant believes that another reference corresponds to U.S. Pat. No. 5,603,681 issued to Olschansky, et al. on Feb. 18, 1997 for Portable multi-exercise system. However, it differs from the present invention because Olschansky, et al. teach a portable multi-exercise system to generate a resistive force responsive to a force applied by a user. The system includes a base frame member formed generally by a planar bottom frame portion and a back frame portion. A rotation actuation mechanism for reversibly imparting a torque about a rotational axis responsive to the force applied by the user is mounted to the base frame member, preferably to the back frame portion thereof. A rotation transfer member having a first portion remaining coaxially aligned with the rotational axis and a second portion pivotally displaceable about that rotational axis in response to the torque is coupled to the rotation actuation mechanism. At least one flexible tension member is connected between the base frame member and this second portion of the rotation transfer member to provide the resistive force necessary to oppose the torque reversibly imparted by the rotation actuation mechanism. The flexible tension member is connected to the second portion of the rotation transfer member by a pivotal coupling. First and second flexible tension members are connected between the base frame and the second portion of the rotation transfer member in such a manner that the first tension member imparts at least one component of force opposing a component of force imparted by the second tension member.

Applicant believes that another reference corresponds to U.S. Pat. No. 6,110,081 issued to Marilyn Barrett on Aug. 29, 2000 for Portable resistance-based exercise apparatus. However, it differs from the present invention because Barrett teaches a portable resistance-type exercise apparatus, which has a hinged, padded platform to support the head and back, a rigid frame including two curved tubes running along either side of the platform, and an elastic cord disposed inside each tube. Each elastic cord has a hand grip for allowing the user to grip the cords securely when doing abdominal exercises. To use the apparatus while doing an abdominal crunch, the user holds onto the hand grips and lifts the torso while pulling the hand grips away from the head and toward the knees at the same time. The obliques can be exercised in a similar manner, by pulling the grip toward the opposite knee while lifting and twisting the torso. The resistance provided by the elastic cords increases the effort required to lift the torso, strengthening the abdominal muscles more quickly than conventional abdominal crunches. The apparatus can also be attached upright to a chair for exercising different muscles in the arms, shoulders and back by changing the direction in which the elastic cords are pulled. A u-shaped frame and a supporting cross member, wherein a single elastic member is threaded through the U-shaped frame and a handgrip is attached to each end of the elastic member.

Applicant believes that another reference corresponds to U.S. Pat. No. 6,267,711 issued to Robert Sylvester Hinds on Jul. 31, 2001 for Elastic cord exercise assembly. However, it differs from the present invention because Hinds teaches an elastic cord exercising assembly optionally capable of mounting upon the face of a door without inflicting damage upon it and comprising guide rails and channels, pulley tethering crossbars for which height is adjustable by employment of spring loaded pin latches, and acentric pulley assemblies which facilitate reestablishing exercise tethering points by the operator, together with accessories including an operator stabilization bar.

Applicant believes that another reference corresponds to U.S. Pat. No. 7,410,450 issued to Kenneth F. Paulding on Aug. 12, 2008 for Portable elastic resistance exercise apparatus. However, it differs from the present invention because Paulding teaches a portable elastic resistance exercise apparatus comprising two panels selectively affixed in a 90 degree angle. Both panels are padded for user interaction. Elastic resistance is positioned as chosen within cutouts in the back panel, at any height and with any resistance chosen. Grips on the resistance enable either grasping or hooking around limbs or body parts. The apparatus folds for portability and also includes non-skid and other anchoring devices for temporary affixation to foreign objects and surfaces. The apparatus therefore offers a truly portable, all-in-one exercise device.

Applicant believes that another reference corresponds to U.S. Pat. No. 7,488,277 issued to Jeffrey M. Knapp on Feb. 10, 2009 for Compact weightlifting frame system. However, it differs from the present invention because Knapp teaches a weight lifting frame system with a rear frame member, first and second side frame members coupled to opposite ends of the rear frame member and a barbell holding and guiding assembly capable of releasably securing a barbell for selectively guided movement of the barbell relative to the side frame members. The assembly is configured to receive and releasably retain the barbell therein, and includes first and second guide members coupleable to the side frame members, and first and second movable holders coupleable to the guide members.

Applicant believes that another reference corresponds to U.S. Pat. No. 7,591,763 issued to Joseph Anthony Fucci on Sep. 22, 2009 for Portable convertible multifunction exercise apparatus and method. However, it differs from the present invention because Fucci teaches a portable, convertible and multifunction exercise apparatus, devices, systems and methods of using that allows individuals to accomplish their fitness, health conditioning, weight loss and rehabilitation goals with a single platform having selectively length adjustable resistance bands. Rotatable spring biased wheels can lock the bands to different lengths, where the longer the length the less resistance, and the shorter the length the more the resistance. The platform can transform from a stepper into a bench to an incline seat with foldable legs. Contained within the platform storage unit are several bars handles and leg attachments. An exercise bar having a rotatable midportion can have handle grip ends removably attachable to the bands and/or the bar so that a variety of additional exercises can be performed allowing the user to exercise all muscle groups for a total body workout.

Applicant believes that another reference corresponds to U.S. Pat. No. 7,621,847 issued to Lamle, et al. on Nov. 24, 2009 for Exercise apparatus. However, it differs from the present invention because Lamle, et al. teach a doorway mounted body exercise apparatus, which has upper and lower horizontal bars bridging the doorway and carrying respective pulleys and, a rearwardly protruding weight set supporting arm which can be swung between either lateral side to the rear of the doorway to accommodate left and right hand hinged doors and can be retracted into the doorway to permit the door to be completely closed while still mounted. Different cabling arrangements enable the weight set to be used as a counter weight for body weight assistance or additional resistance. An upper frame carrying the upper bar is collapsible for removal and storage or to enable a person to walk through the doorway. The lower bar is hinged at one end to the jamb for swinging up against the jamb so as not to obstruct the doorway when not in use. Footpads on the upper frame enable exercising while hanging upside down.

Applicant believes that another reference corresponds to U.S. Pat. No. 9,327,153 issued to Michael Dane Wallisch on May 3, 2016 for Multi-purpose exercise device. However, it differs from the present invention because Wallisch teaches a multi-purpose exercise device includes a first side assembly having a first side assembly short side with an angled first side assembly front foot, a first side assembly long side with an angled first side assembly back foot, and a first elbow provided between the first side assembly short side and the first side assembly long side. The multi-purpose exercise device further includes a second side assembly located parallel to the first side assembly, the second side assembly having a second side assembly short side with an angled second side assembly front foot, a second side assembly long side with an angled second side assembly back foot, and a second elbow provided between the second side assembly short side and the second side assembly long side. At least one brace is provided for connecting the first side assembly to the second side assembly.

Applicant believes that another reference corresponds to U.S. Patent Application Publication No. 2002/0091043, published on Jul. 11, 2002 to Marco L. Rexach for Space efficient multi-use exercise apparatus. However, it differs from the present invention because Rexach teaches an exercise apparatus, which has mounting of the weight stack units on a framework including wall mounted or free-standing rails allows the weight stack units to be moved between various usage positions and a highly compact storage position. The rails have a collapsible or removable segment, for reducing a footprint of the framework in a storage position. In the storage position, the framework forms a storage space that accommodates the weight stack units, a collapsible user support bench, the barbell, and other accessories. This equipment, which may further include, a foldable treadmill and screen monitor, a leg extension and curl attachment, and a preacher curl attachment, may be concealed behind panels provided as part of the apparatus. Each weight stack unit may have attached thereto a Smith guide and bearing. A compact arrangement is provided for reducing momentum of lifted weight plates. An exercise handle assembly has added degrees of freedom to facilitate user forearm and wrist rotation.

Applicant believes that another reference corresponds to U.S. Patent Application Publication No. 20050130814, published on Jun. 16, 2005 to Nitta, Jeffrey A., et al. for Exercise apparatus with reconfigurable frame, resistance system, and platform. However, it differs from the present invention because Nitta, Jeffrey A. et al teach an exercise device that includes a frame portion pivotally connected with a platform portion, and having at least one resistance system releasably connected to the either the frame portion or the platform portion. The frame portion is pivotally attached to the platform portion through a pivot locking device that allows the frame to be fixed in a plurality of positions relative to the platform portion. The resistance system utilizes an elastic member that can be configured with a handle or a belt to allow a user to focus on different muscles. The height and width of the frame portion can be adjusted to conform to the physical characteristics of a user and based on the type of exercise the user is performing. The exercise device is also configured to allow the user to stand or sit in various positions on the platform portion while performing various exercises.

Applicant believes that another reference corresponds to U.S. Patent No. 20060194679 issued to James A. Hatcher on Aug. 31, 2006 for Portable exerciser. However, it differs from the present invention because Hatcher teaches a portable exerciser that includes a mat having first and second primary components that can be collapsed into a smaller arrangement. At least one of the primary components includes at least one exercise handle that can be used by an individual for exercising. An adjustment mechanism is mounted to at least one of the primary components of the mat to enable the first and second primary components to be selectively angularly adjusted and maintained relative to the other primary component.

Applicant believes that another reference corresponds to U.S. Patent Application Publication No. 20100087295, published on Apr. 8, 2010 to Arthur Crawley, IV for Exercise framework apparatus. However, it differs from the present invention because Crawley teaches a substantially rigid framework that may substantially surround and being used in conjunction with a stair-stepping machine for the lower body. An individual may then exercise the upper body using exercise accessories connected to the substantially rigid framework.

Applicant believes that another reference corresponds to EP Patent No. 0215172 issued to Isaac Berger on Nov. 11, 1987 for Portable exercising apparatus. However, it differs from the present invention because Berger teaches an exercising apparatus including a platform on which there are detachably mounted a pair of half-frames, each composed of two erect stanchions detachably secured thereto, the stanchions of each half-frame being detachably interconnected to one another at their upper ends and the stanchions of each half-frame each slidably supporting a pair of vertically spaced bars between which a pair of tension coil springs encircle the stanchions with their ends secured to the bars. The lower bar can be adjusted as to its height by the user thereby enabling tension exerted by the springs to be varied. The upper bar acts as a support for tori that slide along the stanchions. The upper ends of the stanchions are detachably connected to one another by bars. A pulley system is provided interconnecting the bar at the upper ends of the stanchions with the uppermost of the two bars slidable along the stanchions and the rope of the pulley system is supplied with handles at its upper ends to be grasped by an exerciser who pulls against the dead weights of the tori and/or the resistance of the springs.

Other patents describing the closest subject matter provide for a number of more or less complicated features that fail to solve the problem in an efficient and economical way. None of these patents suggest the novel features of the present invention.

SUMMARY OF THE INVENTION

The present invention is an apparatus for exercising, comprising a frame assembly defining a triangular prism shape, which has a frame top bar having connected a first set of frame lateral bars and a second set of frame lateral bars. The frame assembly further comprises first and second frame base bars and first and second frame lateral base bars. The apparatus for exercising further comprises first and second clamp assemblies mounted onto the frame assembly, first and second band assemblies, a strap assembly, first and second upper handle assemblies, and a board assembly. The first and second band assemblies, the strap assembly, the first and second upper handle assemblies, and the board assembly are removable from the frame assembly. The frame assembly is used for exercising alone and/or in conjunction with the first and second band assemblies, the strap assembly, the first and second upper handle assemblies, and the board assembly.

The first set of frame lateral bars is coupled to the first frame lateral base bar, and the second set of frame lateral bars is coupled to the second frame lateral base bar defining respective triangular sides. The first and second frame base bars connect with respective first and second frame lateral base bars to form a quadrilateral base. The frame assembly further comprises corner couplers to connect the first and second frame base bars to respective first and second frame lateral base bars. The frame assembly further comprises first and second lower support bars, first and second upper support bars, first and second lateral upper support bars, and first and second internal bars. The first and second lower support bars, the first and second upper support bars, and the first and second internal bars are removable from the frame assembly. The frame assembly further comprises a base support bar connected from the first frame lateral base bar to the second frame lateral base bar, whereby the first and second frame lateral base bars are positioned opposite to each other.

The first set of frame lateral bars and the second set of frame lateral bars each comprise a plurality of holes, wherein the first and second lower support bars and the first and second upper support bars are fixed. The first and second upper support bars and the first and second internal bars comprise respective mounting structures. The first and second upper support bars mount onto the first and second lateral upper support bars, and the first and second internal bars mount onto the first and second upper support bars. The frame assembly further comprises first and second H frames extending from respective first and second frame base bars to respective first and second lower support bars. The first and second H frames are removable.

The first and second clamp assemblies comprise first and second top clamps and first and second bottom clamps respectively. The first and second clamp assemblies are mounted onto the frame assembly, whereby the first and second top clamps mount onto the frame top bar, and the first and second bottom clamps mount onto the base support bar.

The first and second band assemblies comprise first and second top pulleys, first and second bands, first and second upper handles, first and second lower handles, first and second lower pulleys, first and second upper handle mounting frames, and first and second lower handle mounting frames respectively. The first and second band assemblies are mounted onto the first and second clamp assemblies, whereby the first and second upper handle mounting frames are mounted onto respective first and second top clamps, and the first and second lower handle mounting frames are mounted onto respective the first and second bottom clamps. The first and second bands extend from respective first and second upper handles to respective first and second lower handles, and pass through respective first and second top pulleys and respective first and second lower pulleys.

The strap assembly comprises a strap connector, a strap bind, and first and second straps with respective first and second handles. The strap assembly is mounted onto either of the first and second clamp assemblies, whereby the strap connector mounts onto either of the first and second top clamps.

The first and second upper handle assemblies comprise first and second handles with first and second handle frames respectively. The first and second upper handle assemblies are mounted onto respective first and second clamp assemblies, whereby the first and second handle frames mount onto respective first and second top clamps.

The board assembly comprises a board that mounts onto the first and second lower support bars.

It is therefore one of the main objects of the present invention to provide an apparatus for exercising.

It is another object of this invention to provide an apparatus for exercising, which has a frame assembly.

It is another object of this invention to provide an apparatus for exercising, which has a frame assembly to which additional accessories can be added for exercise purposes.

It is another object of this invention to provide an apparatus for exercising which is safer to use.

It is another object of this invention to provide an apparatus for exercising that can be readily assembled and disassembled without the need of any special tools.

It is another object of this invention to provide an apparatus for exercising, which is of a durable and reliable construction.

It is yet another object of this invention to provide an apparatus for exercising that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
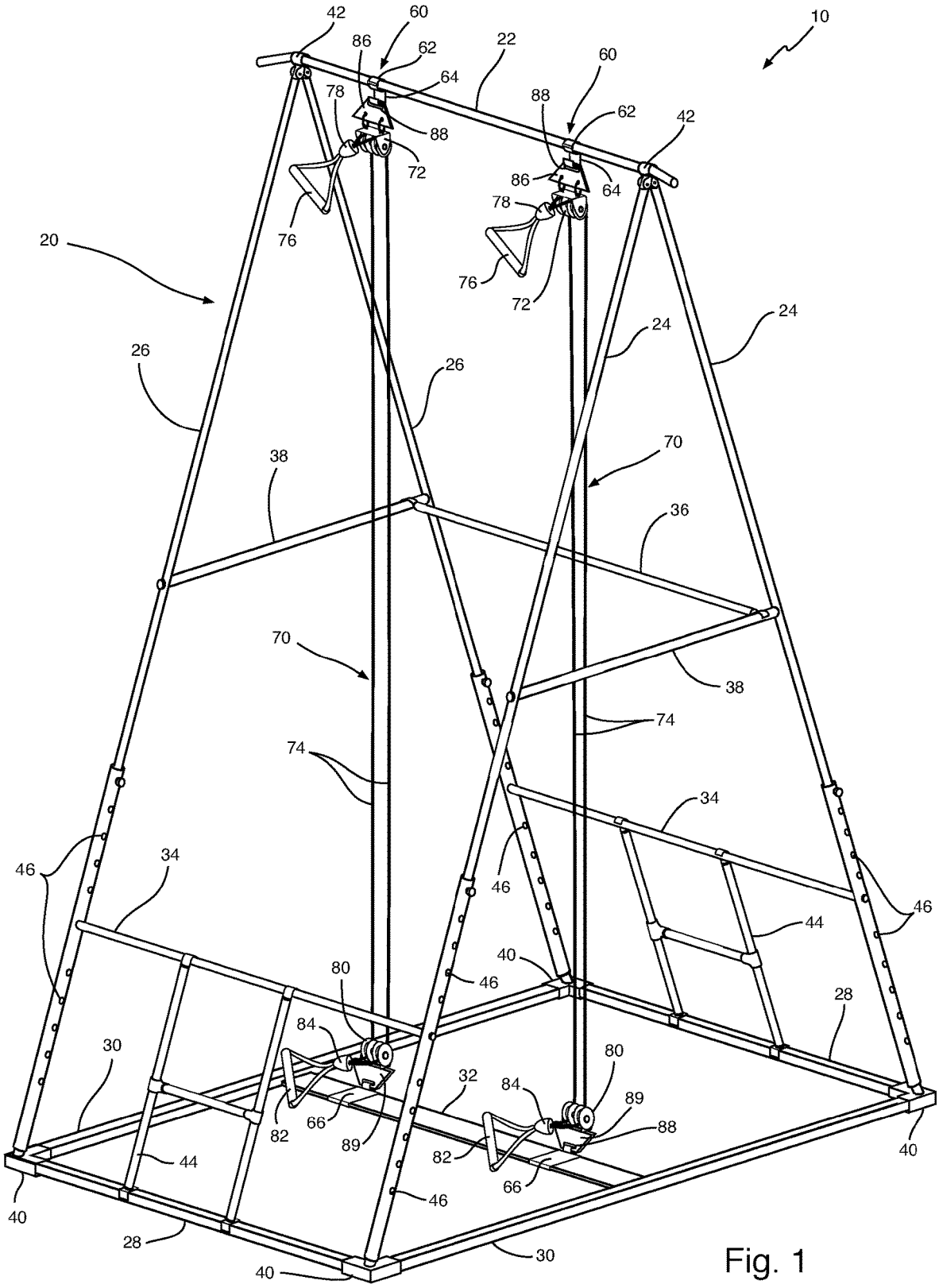
FIG. 1 is an isometric view of the present invention with band assemblies mounted onto a frame assembly.

Referring now to the drawings, the present invention is an apparatus for exercising, and is generally referred to with numeral 10. It can be observed that it basically includes frame assembly 20, first and second clamp assemblies 60, first and second band assemblies 70, strap assembly 90, board assembly 110, and first and second upper handle assemblies 120.

As seen in FIG. 1, frame assembly 20 defines a triangular prism shape. Frame assembly 20 comprises frame top bar 22 having connected first set of frame lateral bars 24 and second set of frame lateral bars 26. Frame assembly 20 further comprises first and second frame base bars 28, and first and second frame lateral base bars 30. In a preferred embodiment, frame top bar 22 comprises first and second couplers 42 to connect first set of frame lateral bars 24 and second set of frame lateral bars 26.

First set of frame lateral bars 24 is coupled to first frame lateral base bar 30, and the second set of frame lateral bars 26 is coupled to second frame lateral base bar 30 defining respective triangular sides. First and second frame base bars 28 connect with first and second frame lateral base bars 30 to form a quadrilateral base. Frame assembly 20 further comprises corner couplers 40 to connect first and second frame base bars 28 to respective first and second frame lateral base bars 30. In a preferred embodiment, frame lateral bars 24 and 26 extend from respective corner couplers 40 to respective couplers 42. Frame assembly 20 further comprises base support bar 32 connected from first to second frame lateral base bar 30 positioned opposite to each other.

Frame assembly 20, further comprises first and second lower support bars 34, and first and second lateral upper support bars 38. Each frame lateral bar 24 and 26 comprises a plurality of holes 46 relatively aligned, wherein first and second lower support bars 34 are fixed. First and second H frames 44 extend from respective first and second frame base bars 28 to respective first and second lower support bars 34. First and second lower support bars 34 and first and second H frames 44 are removable from frame assembly 20. First and second lower support bars 34 may be fixed to any pair of holes 46 allowing that first and second lower support bars 34 be positioned at different heights.

Frame assembly 20 is used for exercising alone and/or in conjunction with other accessories. Frame assembly 20 by itself is useful for exercise certain muscles of the body such as shoulder, arms, and back muscles. In addition, frame assembly 20 may be adapted to work abdomen and leg muscles.

First and second clamp assemblies 60 comprise first and second top clamps 62, and first and second bottom clamps 66. In a preferred embodiment, first and second top clamps 62 comprise respective first and second hooks 64, and first and second bottom clamps 66 comprise respective first and second hooks 68, seen in FIG. 2. First and second clamp assemblies 60 are mounted onto frame assembly 20, whereby first and second top clamps 62 mount onto frame top bar 22, and first and second bottom clamps 66 mount onto base support bar 32.

First and second band assemblies 70 comprise first and second top pulleys 72, first and second bands 74, first and second upper handles 76, first and second lower pulleys 80, and first and second lower handles 82. First and second upper handles 76 comprise respective upper stoppers 78, and first and second lower handles 82 comprise respective lower stoppers 84. First and second band assemblies 70 further comprise respective first and second upper handle mounting frames 86 coupled to respective first and second top pulleys 72, and first and second lower handle mounting frames 89 coupled to respective first and second lower pulleys 80.

First and second band assemblies 70 are mounted onto first and second clamp assemblies 60, whereby first and second upper handle mounting frames 86, having respective first and second elongated holes 88, mount onto respective first and second hooks 64, and first and second lower handle mounting frames 89, having respective third and fourth elongated holes 88, mount onto respective first and second hooks 68. First and second bands 74 extend from respective first and second upper handles 76 to respective first and second lower handles 82, and pass through respective first and second top pulleys 72 and respective first and second lower pulleys 80. First and second band assemblies 70 are removable from first and second clamp assemblies 60. First and second band assemblies 70 are useful for exercising certain muscles of the body such as shoulder, arms, and back muscles.

Figure 2:
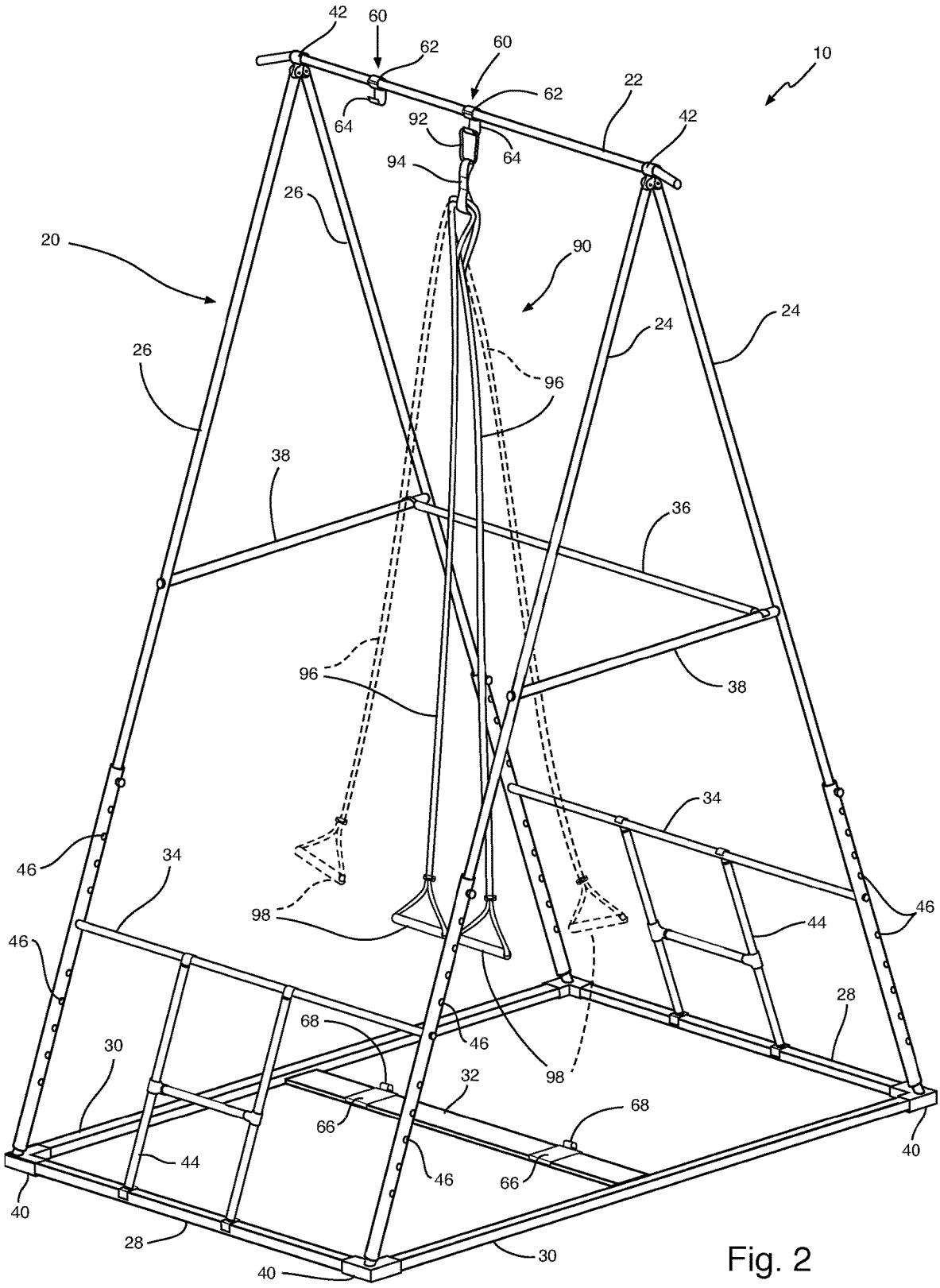
FIG. 2 is an isometric view of the present invention with a strap assembly mounted onto the frame assembly.

As seen in FIG. 2, strap assembly 90 comprises strap connector 92, strap bind 94, and first and second straps 96 with respective first and second handles 98. Strap connector 92 mounts onto first or second top clamps 62, specifically strap connector 92 hangs from first or second hook 64. Strap assembly 90 is removable, and is useful for exercising certain muscles of the body such as abdomen, shoulder, arms, and back muscles.

Figure 3:
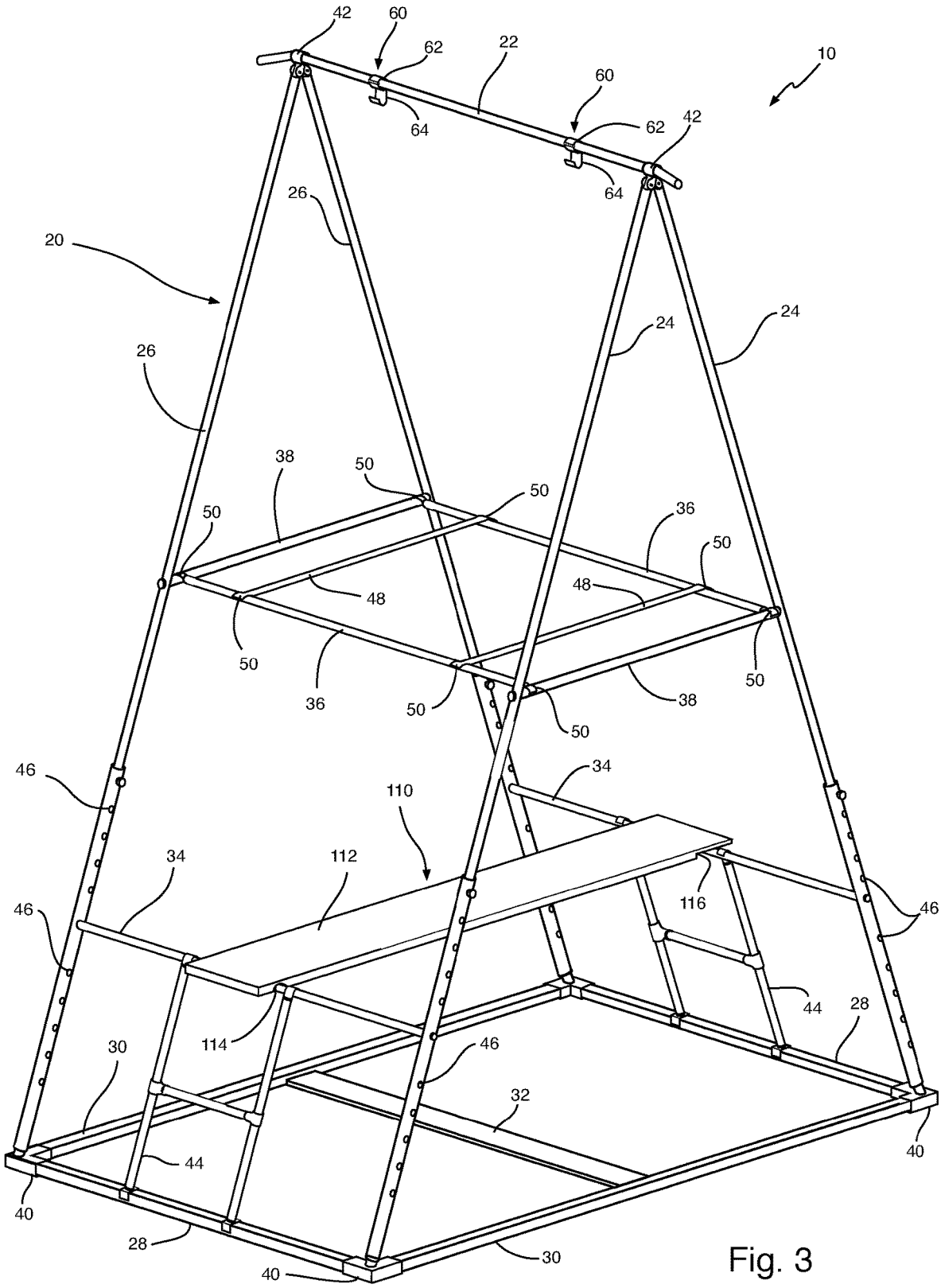
FIG. 3 is an isometric view of the present invention with a board assembly mounted onto the frame assembly.

As seen in FIG. 3, frame assembly 20 further comprises first and second upper support bars 36, and first and second internal bars 48. First and second upper support bars 36 and first and second internal bars 48 comprise mounting structure 50 at each end. In a preferred embodiment, first and second upper support bars 36 mount onto first and second lateral upper support bars 38, and first and second internal bars 48 mount onto first and second upper support bars 36. First and second upper support bars 36 and first and second internal bars 48 are removable from frame assembly 20.

Board assembly 110 comprises board 112 having notch 114 and cutout 116. Board assembly 110 is mounted onto frame assembly 20, whereby board 112 mounts onto first and second lower support bars 34. Notch 114 secures board 112 onto first or second lower support bar 34 and cutout 116 rests onto the opposite lower support bar 34. Board assembly 110 is removable from frame assembly 20, and is useful for exercising certain muscles of the body such as abdomen, and to do weight training.

Figure 4:
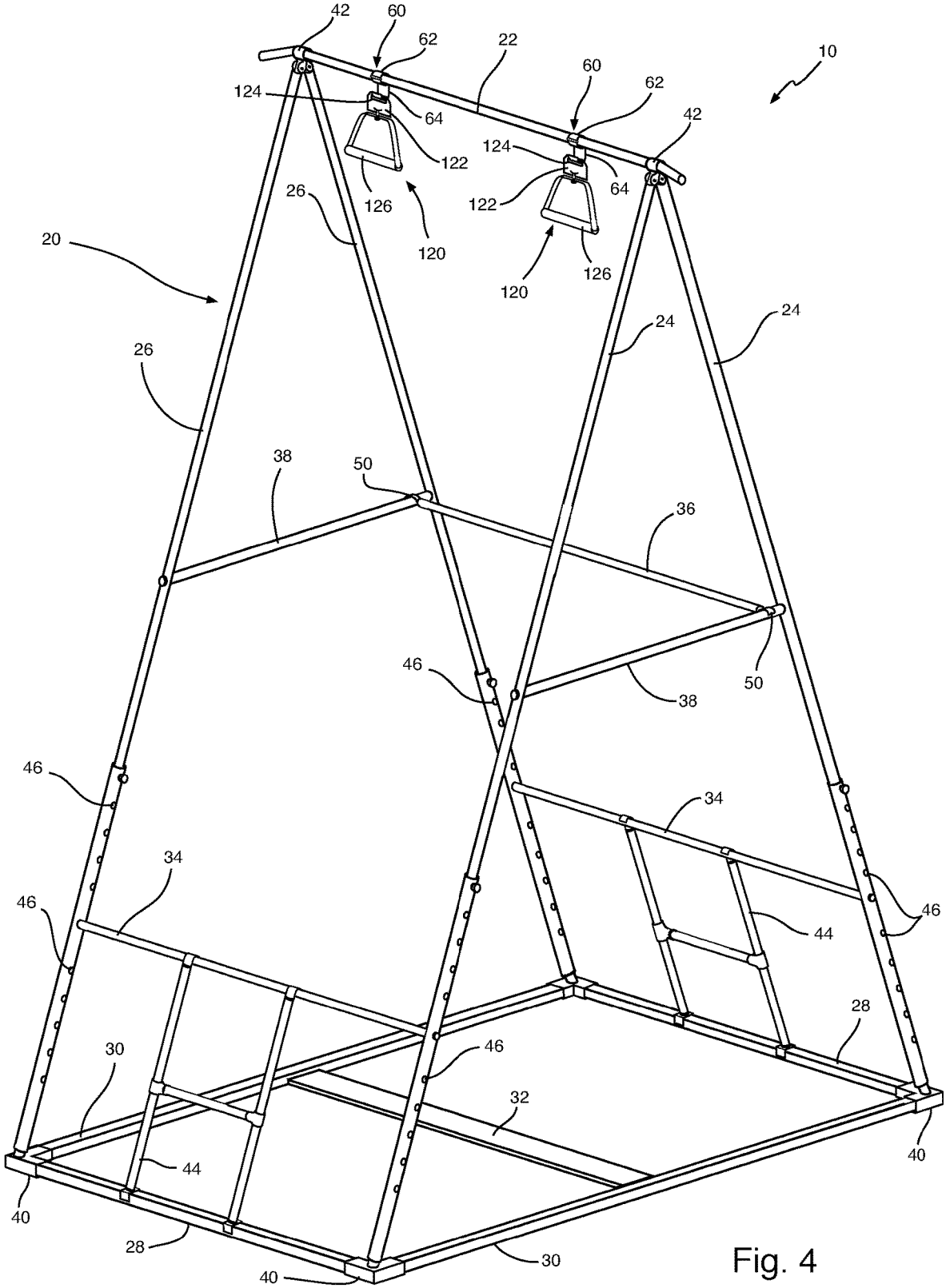
FIG. 4 is an isometric view of the present invention with upper handle assemblies mounted onto the frame assembly.

As seen in FIG. 4, first and second upper handle assemblies 120 comprise first and second handle frames 122 having respective first and second handle frame elongated holes 124, and first and second handles 126. First and second upper handle assemblies 120 are mounted onto first and second clamp assemblies 60, whereby first and second handle frames 122 are mounted onto respective first and second hooks 64 coupled to respective first and second top clamps 62. First and second upper handle assemblies 120 are removable from first and second clamp assemblies 60, and are useful for exercising certain muscles of the body such as shoulder, arms, and back muscles.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. An apparatus for exercising, comprising:

A) a frame assembly defining a triangular prism shape comprising a frame top bar having connected a first set of frame lateral bars and a second set of frame lateral bars, said frame assembly further comprising first and second frame base bars and first and second frame lateral base bars, said frame assembly further comprising first and second lower support bars, first and second upper support bars, first and second lateral upper support bars, and first and second internal bars, said first and second lower support bars, said first and second upper support bars, and said first and second internal bars being removable from said frame assembly, said frame assembly further comprising a base support bar connected to said first frame lateral base bar to said second frame lateral base bar, whereby said first and second frame lateral base bars are positioned opposite to each other, said frame assembly further comprising first and second H frames extending from respective said first and second frame base bars to respective said first and second lower support bars, said first and second H frames being removable;

B) first and second clamp assemblies mounted onto said frame assembly, said first clamp assembly comprising first top clamps and first bottom clamp, and said second clamp assembly comprising second top clamps and second bottom clamp, said first and second clamp assemblies being mounted onto said frame assembly, whereby said first and second top clamps mount onto said frame top bar, and said first and second bottom clamps mount onto said base support bar;

C) first and second band assemblies;

D) a strap assembly;

E) first and second upper handle assemblies; and

F) a board assembly, wherein said first and second band assemblies, said strap assembly, said first and second upper handle assemblies, and said board assembly are removable from said frame assembly, said frame assembly is adapted to be used for exercising alone and/or in conjunction with said first and second band assemblies, said strap assembly, said first and second upper handle assemblies, and said board assembly.

2. The apparatus for exercising set forth in claim 1, wherein said first set of frame lateral bars is coupled to said first frame lateral base bar, and said second set of frame lateral bars are coupled to said second frame lateral base bar defining respective triangular sides.

3. The apparatus for exercising set forth in claim 1, wherein said first and second frame base bars connect with respective said first and second frame lateral base bars to form a quadrilateral base.

4. The apparatus for exercising set forth in claim 1, wherein said frame assembly further comprises corner couplers to connect said first and second frame base bars to respective said first and second frame lateral base bars.

5. The apparatus for exercising set forth in claim 1, wherein said first set of frame lateral bars and said second set of frame lateral bars each comprise a plurality of holes, wherein said first and second lower support bars and said first and second lateral upper support bars are fixed.

6. The apparatus for exercising set forth in claim 1, wherein said first and second upper support bars and said first and second internal bars comprise respective mounting structures.

7. The apparatus for exercising set forth in claim 1, wherein said first and second upper support bars mount onto said first and second lateral upper support bars, and said first and second internal bars mount onto said first and second upper support bars.

8. The apparatus for exercising set forth in claim 1, wherein said first and second band assemblies comprise first and second top pulleys, first and second bands, first and second upper handles, first and second lower handles, first and second lower pulleys, first and second upper handle mounting frames, and first and second lower handle mounting frames respectively.

9. The apparatus for exercising set forth in claim 8, wherein said first and second band assemblies are mounted onto said first and second clamp assemblies, whereby said first and second upper handle mounting frames are mounted onto respective said first and second top clamps, and said first and second lower handle mounting frames are mounted onto respective said first and second bottom clamps.

10. The apparatus for exercising set forth in claim 8, wherein said first and second bands extend from respective said first and second upper handles to respective said first and second lower handles, and pass through respective said first and second top pulleys and respective said first and second lower pulleys.

11. The apparatus for exercising set forth in claim 1, wherein said strap assembly comprises a strap connector, a strap bind, and first and second straps with respective first and second handles, said strap assembly is mounted onto either of said first and second clamp assemblies, whereby said strap connector mounts onto either of said first and second top clamps.

12. The apparatus for exercising set forth in claim 1, wherein said first and second upper handle assemblies comprise first and second handles with first and second handle frames respectively, said first and second upper handle assemblies are mounted onto respective said first and second clamp assemblies, whereby said first and second handle frames mount onto respective said first and second top clamps.

13. The apparatus for exercising set forth in claim 1, wherein said board assembly comprises a board that mounts onto said first and second lower support bars.

* * * * *